US007694924B2

(12) United States Patent
Magnusson

(10) Patent No.: US 7,694,924 B2
(45) Date of Patent: Apr. 13, 2010

(54) SUPPORT ASSEMBLY FOR WORK SURFACE

(75) Inventor: Carl Gustav Magnusson, New York, NY (US)

(73) Assignee: TK Canada Limited, Toronto, Ontario (CA)

( * ) Notice: Subject to any disclaimer, the term of this patent is extended or adjusted under 35 U.S.C. 154(b) by 216 days.

(21) Appl. No.: 11/848,605

(22) Filed: Aug. 31, 2007

(65) Prior Publication Data

US 2009/0056598 A1 Mar. 5, 2009

(51) Int. Cl.
*F16M 11/20* (2006.01)

(52) U.S. Cl. ..... 248/188.1; 108/156

(58) Field of Classification Search ..... 248/188.1, 248/188.4, 188.5, 165; 182/181.1, 113, 222; 108/156

See application file for complete search history.

(56) References Cited

U.S. PATENT DOCUMENTS

| | | | | |
|---|---|---|---|---|
| 3,049,386 | A | 8/1962 | Prud'homme | |
| D254,890 | S | 5/1980 | Wilson | |
| D255,521 | S | 6/1980 | Wilson | |
| D270,411 | S * | 9/1983 | DeGregori | D6/480 |
| 4,543,761 | A * | 10/1985 | Mockovciak, Jr. | 52/652.1 |
| 4,748,913 | A * | 6/1988 | Favaretto et al. | 108/50.02 |
| 4,750,662 | A * | 6/1988 | Kagimoto | 228/44.5 |
| 5,092,571 | A * | 3/1992 | Stevens | 269/296 |
| 5,289,784 | A | 3/1994 | Waibel | |
| D404,939 | S * | 2/1999 | Frank et al. | D6/495 |
| 6,069,321 | A * | 5/2000 | Wagener et al. | 174/99 B |
| 6,672,011 | B2 | 1/2004 | Garner et al. | |
| 7,048,021 | B2 * | 5/2006 | Ayala et al. | 144/287 |
| 7,437,859 | B2 * | 10/2008 | Stolarov | 52/631 |
| 2005/0149033 | A1 * | 7/2005 | McGuire et al. | 606/77 |

* cited by examiner

*Primary Examiner*—Korie H. Chan
(74) *Attorney, Agent, or Firm*—Katten Muchin Rosenman LLP

(57) ABSTRACT

A support assembly for a work surface is disclosed. The support assembly may be secured to at least one gable. The support assembly includes an elongate horizontal support having a predetermined cross-sectional shape a saddle support which supports the work surface. The saddle support has a recess with a shape which corresponds to the predetermined cross sectional shape of the horizontal support. The recess receives the horizontal support therein to securely rest the saddle support on a top portion of the horizontal support. A U-shaped fastener secures an upper member of the horizontal support to an upper portion of the recess.

7 Claims, 4 Drawing Sheets

SUPPORT ASSEMBLY FOR WORK SURFACE

FIELD OF THE INVENTION

The invention relates to furniture, and in particular to a support assembly for a work surface, such as a table top or the like.

BACKGROUND OF THE INVENTION

Adjustable, easily assembled, and modular furniture systems are particularly useful in office environments. Customers for such office furniture systems often demand work surfaces for boardroom tables or the like have a specific size or configuration, as well as having an aesthetically pleasing appearance.

Suppliers of such furniture systems strive to design tables so that they can easily and securely be assembled into a variety of sizes and configurations.

SUMMARY OF THE INVENTION

According to one aspect of the invention, a support assembly for a work surface is provided. The support assembly may be secured to at least one gable the support assembly comprises:

a) an elongate horizontal support having a predetermined cross-sectional shape;

b) a saddle support adapted to support the work surface, the saddle support defining a recess having a shape corresponding to the predetermined cross sectional shape of the horizontal support, wherein the recess receives the horizontal support therein to securely rest the saddle support on a top portion of the horizontal support; and c) a fastener adapted to secure an upper member of the horizontal support to an upper portion of the recess.

Preferably, the fastener is a U-shaped fastener comprising: (i) an arcuate central portion which passes under the upper member of the horizontal support, and (ii) a pair of ends projecting upwardly through a pair of holes in the saddle support.

The predetermined cross-sectional shape is preferably a triangular shape.

DETAILED DESCRIPTION OF THE INVENTION

Figure 1:
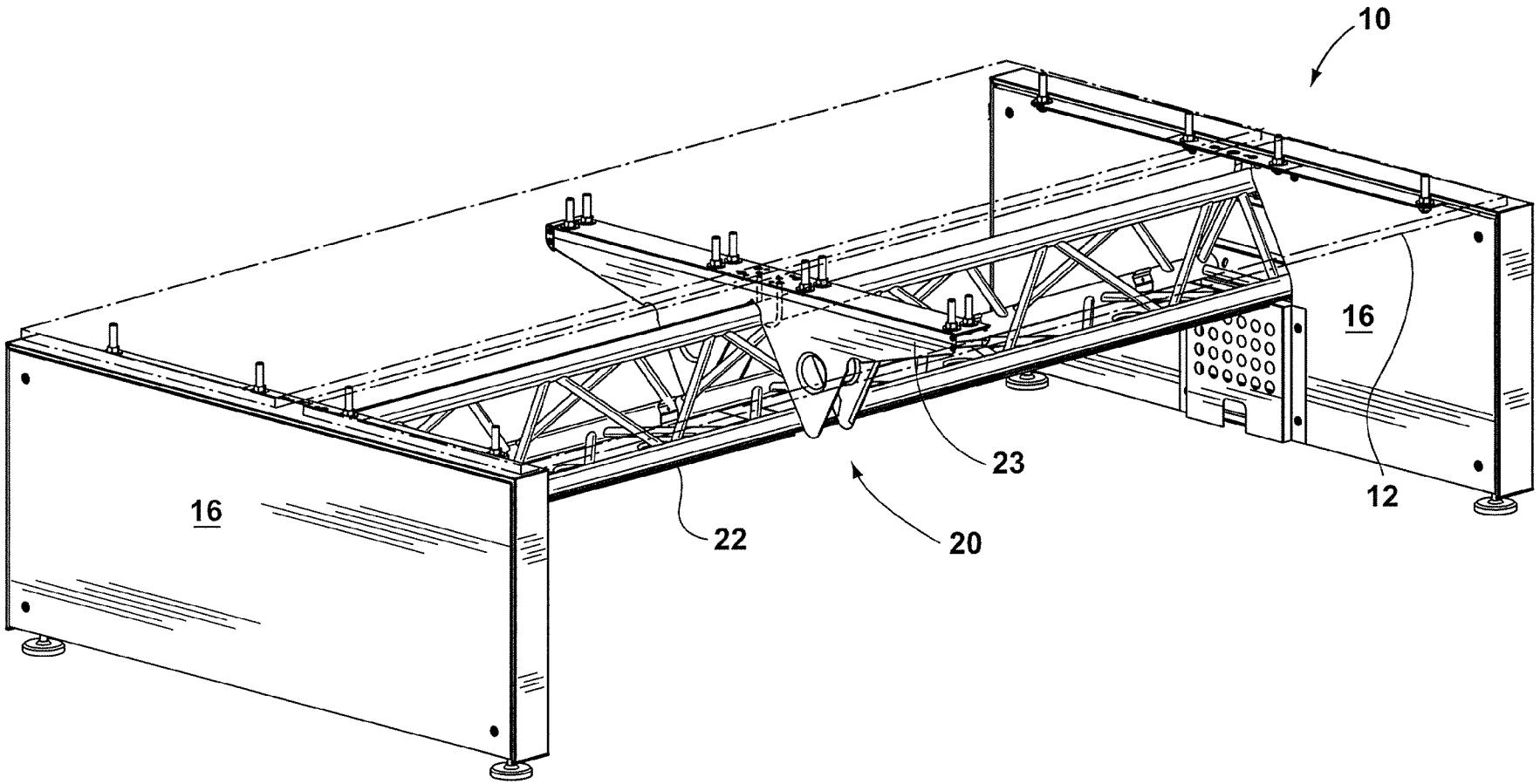
FIG. 1 is a perspective view of a boardroom table which incorporates a support assembly according to a preferred embodiment of the present invention.

FIG. 1 shows a boardroom table 10 which incorporates a support assembly 20 according to a preferred embodiment of the present invention. However, it will be understood by those skilled in the art that the present invention may be used to support any suitable type of table top, work surface, or the like.

Figure 2:
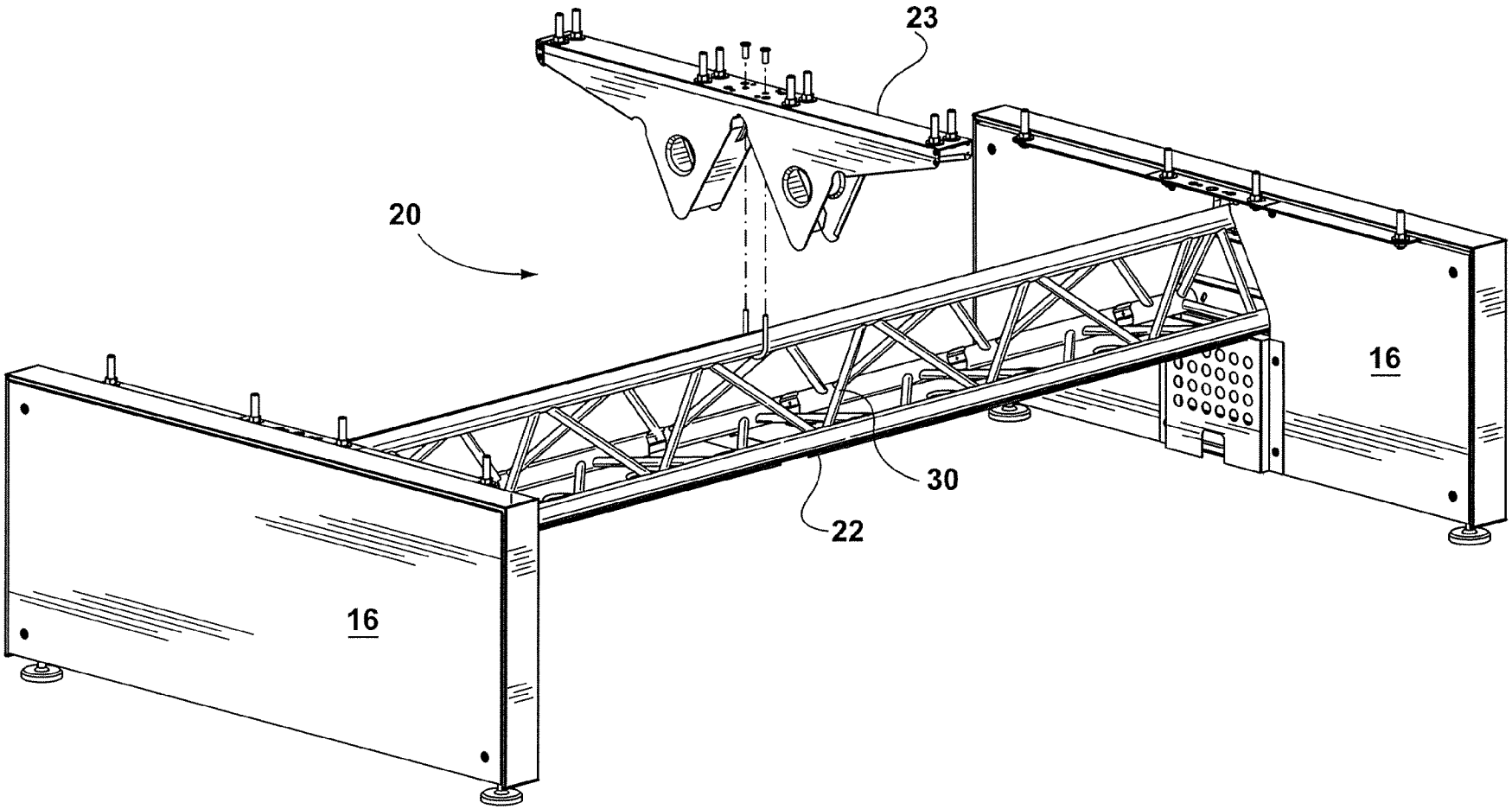
FIG. 2 is an exploded perspective view of the preferred embodiment connected to a pair of gables.

Referring now to FIGS. 1 and 2, the boardroom table 10 includes a work surface 12 (also referred to as a table top) which is supported by the support assembly 20 according to a preferred embodiment of the present invention. The support assembly 20 is preferably secured to one or more gables 16 which rest on the floor. As used herein, "gable" means any structure that rests on the floor and is capable of supporting the support assembly 20, such as for example, legs or the like.

Figure 3:
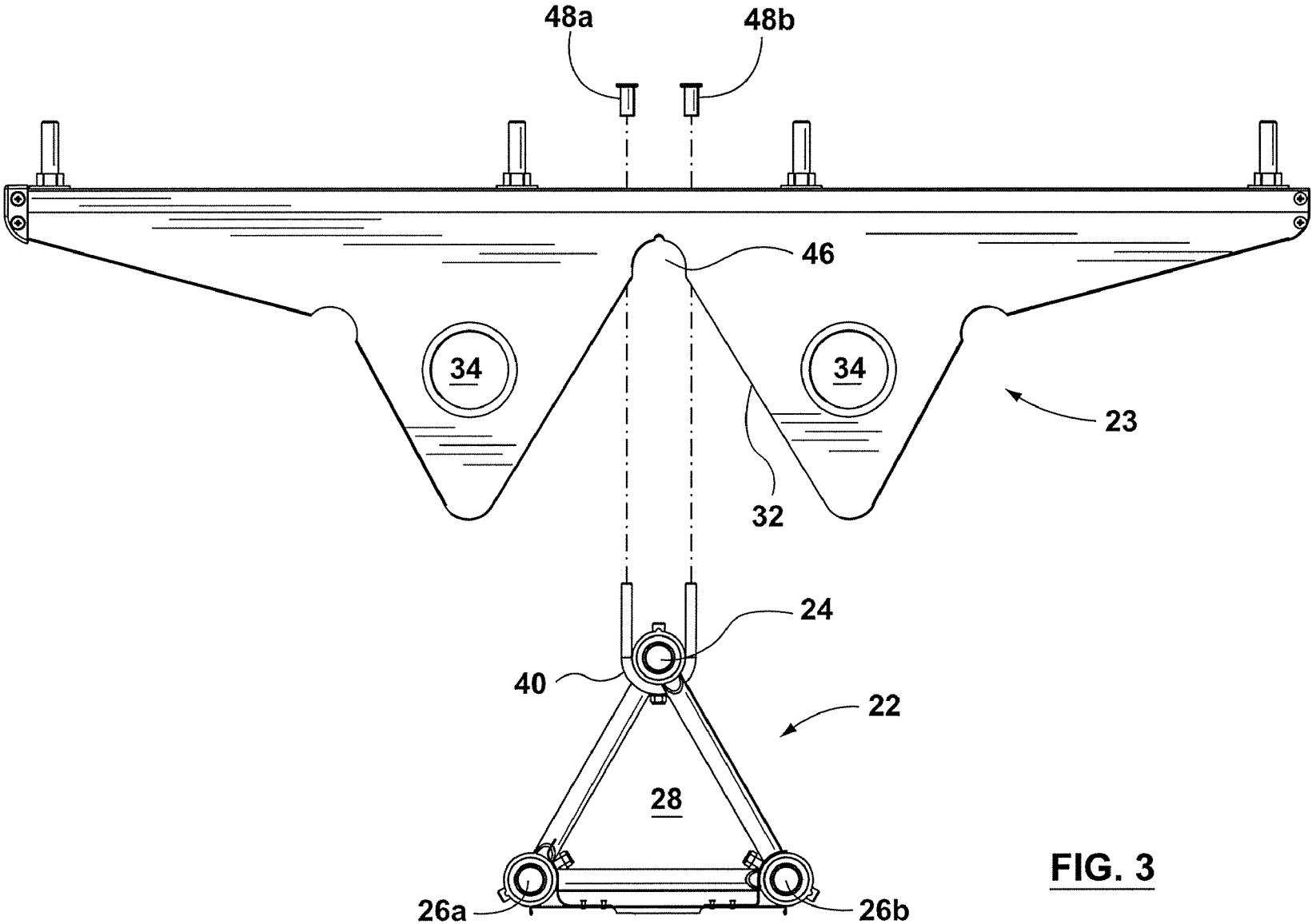
FIG. 3 is an exploded elevation view of the preferred embodiment.
Figure 4:
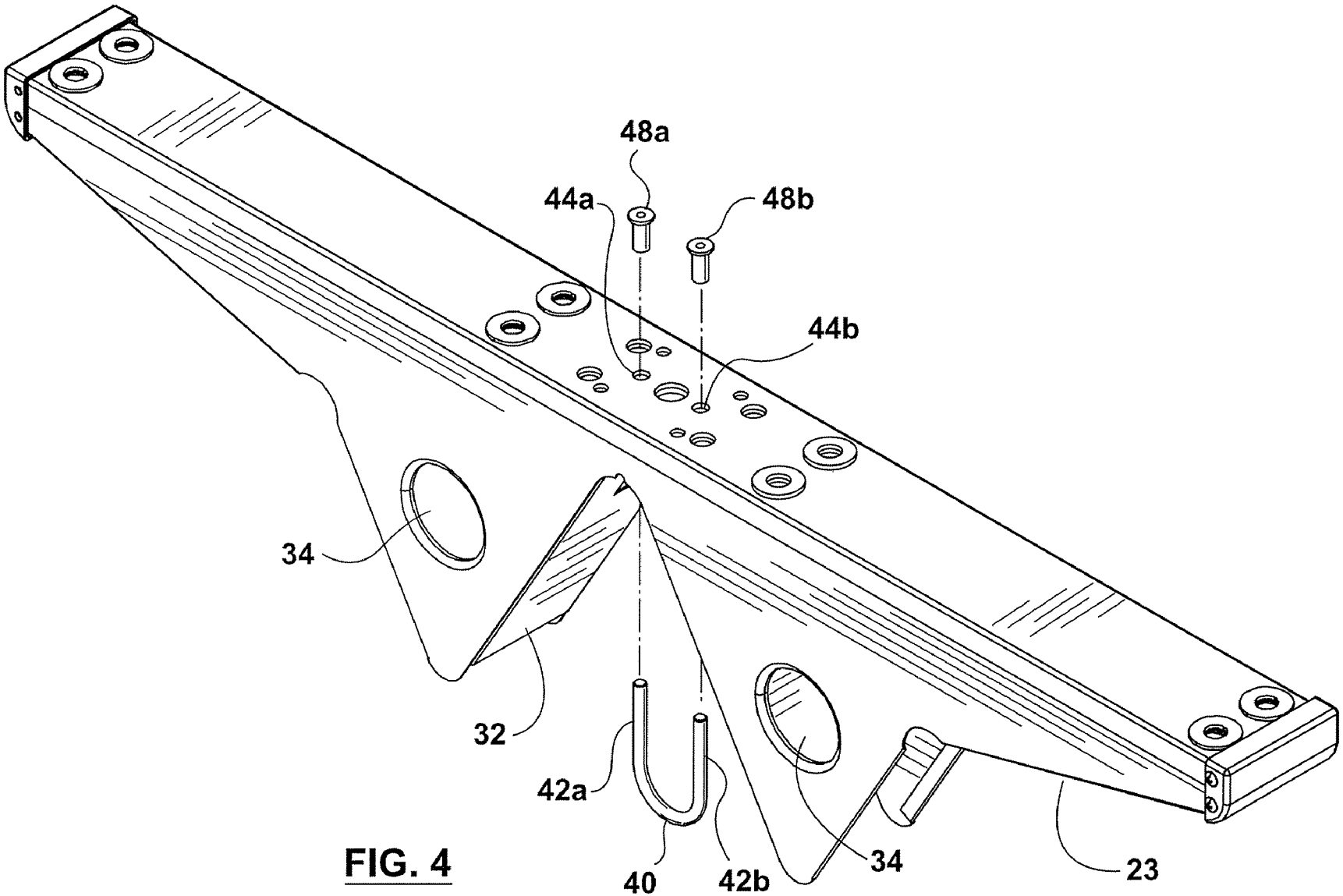
FIG. 4 is an exploded perspective view of a saddle support and a U-shaped fastener, according to a preferred embodiment of the present invention.

The support assembly 20 includes an elongate horizontal support 22 and a saddle support 23. Referring now to FIGS. 3 and 4, the horizontal support 22 is made up of an upper member 24 and two lower members 26*a*, 26*b* arranged in a triangular cross-sectional shape 28.

Referring again to FIGS. 1 and 2, a number of struts 30 connect each of the upper and lower members to form a truss support. Each end of the horizontal support 22 may be secured to the gables 16 in any suitable fashion, such as by fasteners (not shown). In order to provide a modular system, several horizontal supports 22 may be connected end-to-end to support a larger work surface. In such case, intermediate supports (not shown) may be provided at the connection points of two horizontal supports 22.

Referring again to FIGS. 3 and 4, the saddle support 23 includes a recess 32 in its lower portion. Preferably, the recess has a triangular shape which corresponds to the cross-sectional shape 28 of the horizontal support 22. Openings 34 may be provided in the saddle support 23 to accommodate cables or the like.

The saddle support 23 is mounted on top of the horizontal support, such that the support is received within the recess 32 (best shown in FIG. 1). The matching triangular shapes of the support and horizontal support enable the saddle support to be securely mounted on top of the horizontal support 22.

Continuing to refer to FIGS. 3 and 4, a preferably U-shaped fastener 40 further secures the saddle support 23 to the horizontal support 22. The U-shaped fastener 40 fits around the upper member 24 of the horizontal support 22. The U-shaped fastener 40 includes a pair of hollow internally threaded ends 42*a*, 42*b* which pass through openings 44*a*, 44*b* in an upper portion 46 of the recess 32 an project upwardly out of the saddle support 23. Screws 48*a*, 48*b* are received within the ends 42*a*, 42*b* respectively to better secure the saddle support to the horizontal support 22.

The preferred embodiment of the invention described above provides several advantages over the prior art. In particular, the saddle support 23, which is preferably manufactured as a one piece component, replaces a typical prior art assembly which requires four brackets. In addition, the saddle support 23 is connected to the horizontal support 22 using only the U-shaped fastener 40, while four to sixteen fasteners may be required to secure prior art assemblies. The above advantages result in significantly faster assembly times and potential cost reductions.

While the present invention as herein shown and described in detail is fully capable of attaining the above-described objects of the invention, it is to be understood that it is the presently preferred embodiment of the present invention and thus, is representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known or later come to be known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims.

The invention claimed is:

1. A support assembly for a work surface, the support assembly securable to at least one gable, the support assembly comprising:

a) an elongate horizontal support having a triangular cross-sectional shape;

b) a saddle support comprising an upper surface and a lower surface, wherein the upper surface is adapted to support the work surface, wherein the lower surface of the saddle support defines a recess extending upwardly from the lower surface, wherein the recess in the lower surface of the saddle support has a triangular shape, wherein the recess receives the horizontal support therein to securely rest the saddle support on a top portion of the horizontal support; and c) a fastener adapted to secure an upper member of the horizontal support to an upper portion of the recess.

2. The support assembly of claim 1, wherein the fastener is a U-shaped fastener comprising:

d) an arcuate central portion which passes under the upper member of the horizontal support; and e) a pair of ends projecting upwardly through a pair of holes in the saddle support.

3. The support assembly of claim 2, wherein the ends of the U-shaped fastener are internally threaded and adapted to receive a corresponding pair of screws to secure the horizontal support to the saddle support.

4. The support assembly of claim 2, wherein the horizontal support comprises:

f) the upper member and a pair of lower members, wherein the upper member and lower members are in substantially parallel relation to each other; and g) a plurality of struts running between each of the upper and lower members to secure the upper and lower members to each other.

5. The support assembly of claim 4, wherein the upper member and the pair of lower members each define a vertex of the triangular cross-sectional shape.

6. A support assembly for a work surface, the support assembly securable to at least one gable, the support assembly comprising:

h) an elongate horizontal support having a triangular cross-sectional shape;

i) a saddle support comprising an upper surface and a lower surface, wherein the upper surface is adapted to support the work surface, wherein the lower surface of the saddle support defines a recess extending upwardly from the lower surface, wherein the recess in the lower surface of the saddle support has a triangular shape, wherein the recess receives the horizontal support therein to securely rest the saddle support on a top portion of the horizontal support; and j) a U-shaped fastener adapted to secure an upper member of the horizontal support to an upper portion of the recess, the U-shaped fastener comprising:

i) an arcuate central portion which passes under the upper member of the horizontal support; and ii) a pair of ends projecting upwardly through a pair of holes in the saddle support.

7. The support assembly of claim 6, wherein the ends of the U-shaped fastener are internally threaded and adapted to receive a corresponding pair of screws to secure the horizontal support to the saddle support.

* * * * *